US005993330A

United States Patent [19]

Akerstrom

[11] Patent Number: 5,993,330

[45] Date of Patent: Nov. 30, 1999

[54] GOLF PUTTER HEAD

[76] Inventor: Thomas Chester Akerstrom, 18336 Soledad Canyon Rd., Canyon Country, Calif. 91351

[21] Appl. No.: 09/133,922

[22] Filed: Aug. 13, 1998

[51] Int. Cl.[6] ..... A63B 53/04

[52] U.S. Cl. ..... 473/340; 473/341

[58] Field of Search ..... 473/249, 251, 473/324, 327, 340, 341, 313, 292, 293

[56] References Cited

U.S. PATENT DOCUMENTS

| | | | |
|---|---|---|---|
| 1,589,926 | 6/1926 | Beamer | 473/340 |
| 4,324,404 | 4/1982 | Dian | 473/340 |
| 4,592,552 | 6/1986 | Garber | 273/168 |
| 4,747,599 | 5/1988 | Antonious | 273/167 G |
| 5,246,231 | 9/1993 | Antonious | 273/167 F |
| 5,324,031 | 6/1994 | Green | 473/340 X |
| 5,458,332 | 10/1995 | Fisher | 273/78 |
| 5,464,215 | 11/1995 | Kochler | 273/167 R |
| 5,467,987 | 11/1995 | Perkins et al. | 473/340 |
| 5,665,011 | 9/1997 | Thomas | 473/324 |
| 5,803,825 | 9/1998 | Hamilton | 473/252 |

*Primary Examiner*—Kien T. Nguyen

[57] ABSTRACT

A golf putter head having a generally disk like shape with top and bottom surfaces substantially circular in shape, a rounded rear surface and a front surface being flattened thereby providing a face for striking a golf ball. The width of this face being approximately one third the width of the putter head. The putter head having a center of gravity positioned behind the face of the putter head at a distance of approximately one half the putter head length and an alignment stripe on its top surface. The unique shape of this putter head, alignment stripe, size and position of the putter head face, and location of the putter head center of gravity allows the putter head to: (1) improve and simplify the pre-putt alignment procedure, (2) consistently impact the golf ball on "sweet spot" of the putter head face thereby eliminating weak and ineffective putts, (3) have a shorter more controlled putter head backswing with a resulting high percentage of positive contact with the golf ball, and (4) eliminate putter head twist when impacting the golf ball thereby reducing misdirected putts.

4 Claims, 7 Drawing Sheets

GOLF PUTTER HEAD

BACKGROUND

1. Field of Invention

This invention relates to an improved golf putter head.

2. Description of Prior Art

Putting is often considered the most difficult part of the game of golf. When putting, the golf ball must be hit with a precise amount of force and in a precise direction. If not, the golf ball will either nor reach the cup (i.e. hole) or it will miss the cup on one side or the other. Various attempts have been made to design putters and in particular putter heads which will impart the precise amount of force and direction to a golf ball to successfully complete a putt. Applicant is aware of a number of U.S. patents which disclose various structural improvements to golf club putters and in particular golf club putter heads as follows:

| | |
|---|---|
| 4,592,552 | Garber |
| 4,747,599 | Antonious |
| 5,246,231 | Antonious |
| 5,458,332 | Fisher |
| 5,464,215 | Koehler |

A review of the above patents as well as other putter patents up to the present time will reveal that most putter head designs are variations of either a blade type putter head or a mallet type putter head and that both these types of putter heads are affected by parameters which can cause mis-hit and misdirected putts. Among these parameters are the width of the putter head face (Fw), the length of the putter head (H1), and the location of the putter head center of gravity (C.G.).

The face or front of the putter head is that portion of the head which actually makes direct contact with the golf ball. Most blade type and mallet type putter heads employ a face that is usually as wide or almost as wide as the widest portion of the head. Typically, blade type putter heads have face widths greater than 4 inches while mallet type heads have face widths greater than 3 inches. The length of the putter head is defined as the distance from the face to the back the putter head. The width of the putter head face and the length of the putter head are factors in successful putting in that they affect (1) the pre-putt alignment of the the putter head, (2) the impacting of the golf ball on the "sweet spot " of the putter face, and (3) the location of the putter head center of gravity.

Pre-putt alignment of a blade or mallet type putter head is normally accomplished by determining a line of sight to the cup and and then positioning the putter head behind the golf ball on that line of sight with the putter head face perpendicular to the line of sight. If the face of the putter head is not perpendicular to the line of sight to the cup when the putter head impacts the ball, misdirection of the putt will occur. As the length of the putt increases, even a small misalignment (i.e. a few degrees off perpendicular) will result in a missed putt. The alignment procedure could be simplified and improved by reducing putter head face width (Fw) so as to allow only a small facial area to impact the golf ball, increasing putter head length (H1), and putting an alignment stripe with dimensions (Fw×H1) on the top of the putter head These changes would eliminate the need for positioning the putter head face perpendicular to the line of sight during pre-putt alignment. Alignment would consist only of placing the putter head face behind the golf ball with the alignment stripe positioned on the line of sight to the cup.

Impacting the golf ball on the sweet spot of the putter face involves determining the location of this spot and then consistently hitting the ball there. The sweet spot can be defined as a small area (typically having a width no greater than one half inch) on the face of a putter head that can impact a golf ball with the required force utilizing the shortest possible putter stroke to successfully complete a putt. The sweet spot is normally located such that a vertical middle plane will bisect the sweet spot, the putter head face, and pass through the putter head center of gravity. For example, the sweet spot on a blade type putter head face four and one half inches wide would normally be centered on the putter head face two and a quarter inches from either end of the blade. Error in the form of weak and ineffectual putts is introduced when the golf ball does not impact the sweet spot, and this error becomes greater as the distance between the sweet spot and the point of impact increases. Also, impacting the golf ball at or near the end of a mallet or blade type putter head can cause putter head twist resulting in misdirected putts. Reducing putter head face width to a fraction of the putter head width (for example one third) and positioning the face front and center on the putter head would minimize these problems.

The location of the center of gravity of the putter head is also a factor in successful putting in that increasing the distance between the center of gravity and the face of the putter head allows the golfer to take a shorter more controlled backswing of the putter head resulting in a higher percentage of positive contact with the golf ball. For a putter head of uniform density, this distance will increase as the length of the putter head is increased.

OBJECTS AND ADVANTAGES

The objective of the present invention is to make a marked improvement over prior art in terms of a golf putter head that provides greater accuracy and control while putting.

By virtue of its unique design, the golf putter head of the present invention offers the following advantages over prior art:

(a) It allows the pre-putt alignment procedure to be simplified and improved thereby providing more accurate putts.

(b) It will consistently impact the golf ball on "sweet spot" of the putter head face thereby eliminating weak and ineffective putts.

(c) It provides a shorter more controlled putter head backswing with a resulting high percentage of positive contact with the golf ball.

(d) It eliminates putter head twist when impacting the golf ball thereby reducing misdirected putts.

DRAWINGS FIGURES

The present invention will now be described by way of example with reference to the accompanying drawings as compared with conventional putter heads.

REFERENCE NUMERALS IN DRAWINGS

| | |
|---|---|
| 10 conventional blade type putter head | 12 conventional mallet type putter head |
| 14 putter head of the present invention | 16 putter head face |
| 18 bore hole | 20 alignment stripe |
| 22 top of putter head | 24 bottom of putter head |
| 26 rear surface of putter head | |

Description—FIGS. 1 to 6

The putter head of the present invention will now be described by referring to accompanying drawings and by making comparisons to conventional putter heads.

Figure 1A:
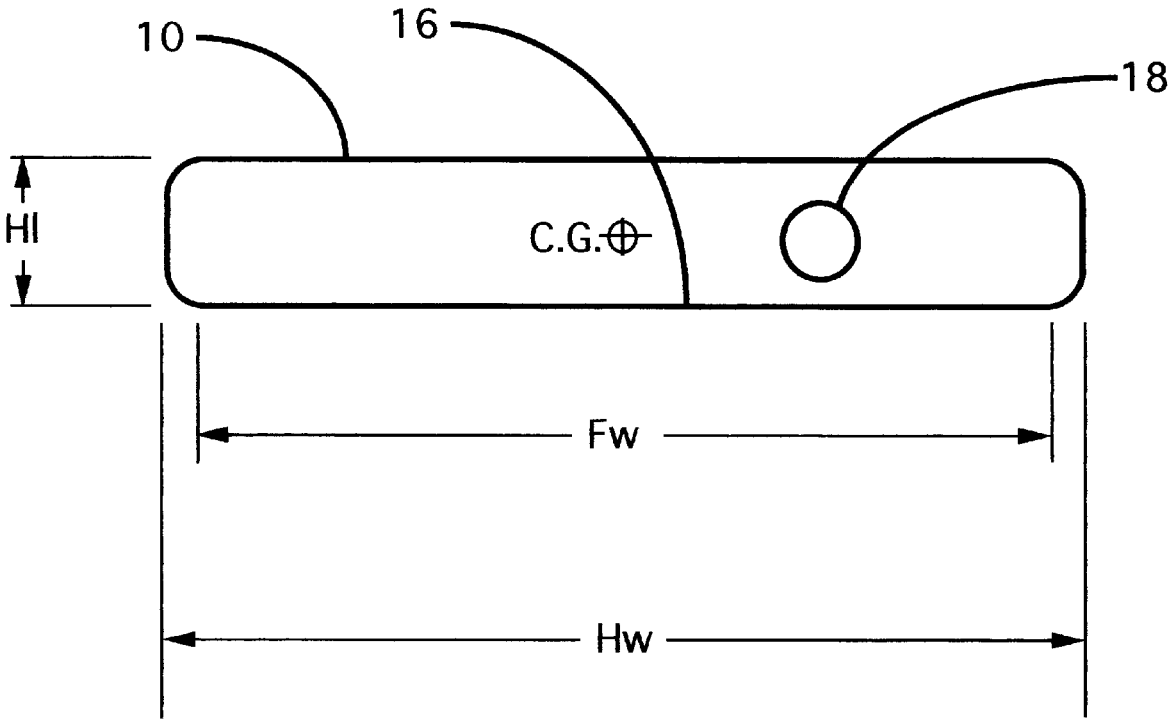
PRIOR ART FIGURE 1A
FIG. 1A is a top view of a conventional blade type putter head.

FIG. 1A is a top view of a conventional blade type putter head 10. In this conventional configuration, the putter head face width Fw is only slightly less than the width of putter head Hw. The putter head length H1 is significantly less than the putter head width Hw causing the center of gravity C.G. to be relatively close to the putter head face 16. Pre-putt alignment of this putter head will entail determining a line of sight to the cup and then positioning the sweet spot of the putter head face behind the golf ball on that line of sight with the putter head face perpendicular to that line of sight. If the face of this putter head is not perpendicular to the line of sight when the putter head impacts the golf ball or if impact is not made at or very near the sweet spot of the putter head face, a misdirected and/or a weak and ineffective putt will occur. Also, if not gripped firmly, a putter having a head with a wide face such as this one can twist in a golfer's hands if the putter head impacts the golf ball at or near the end of the putter head, resulting in a misdirected putt. Another problem associated with blade type putter heads such as shown in this figure is the close proxmity of the C.G. to the putter head face 16. This close proxmity reduces control during the backswing of the putter resulting in a lower percentage of positive contact with the golf ball. Shown also in this figure is bore hole 18 which receives the putter shaft.

Figure 1B:
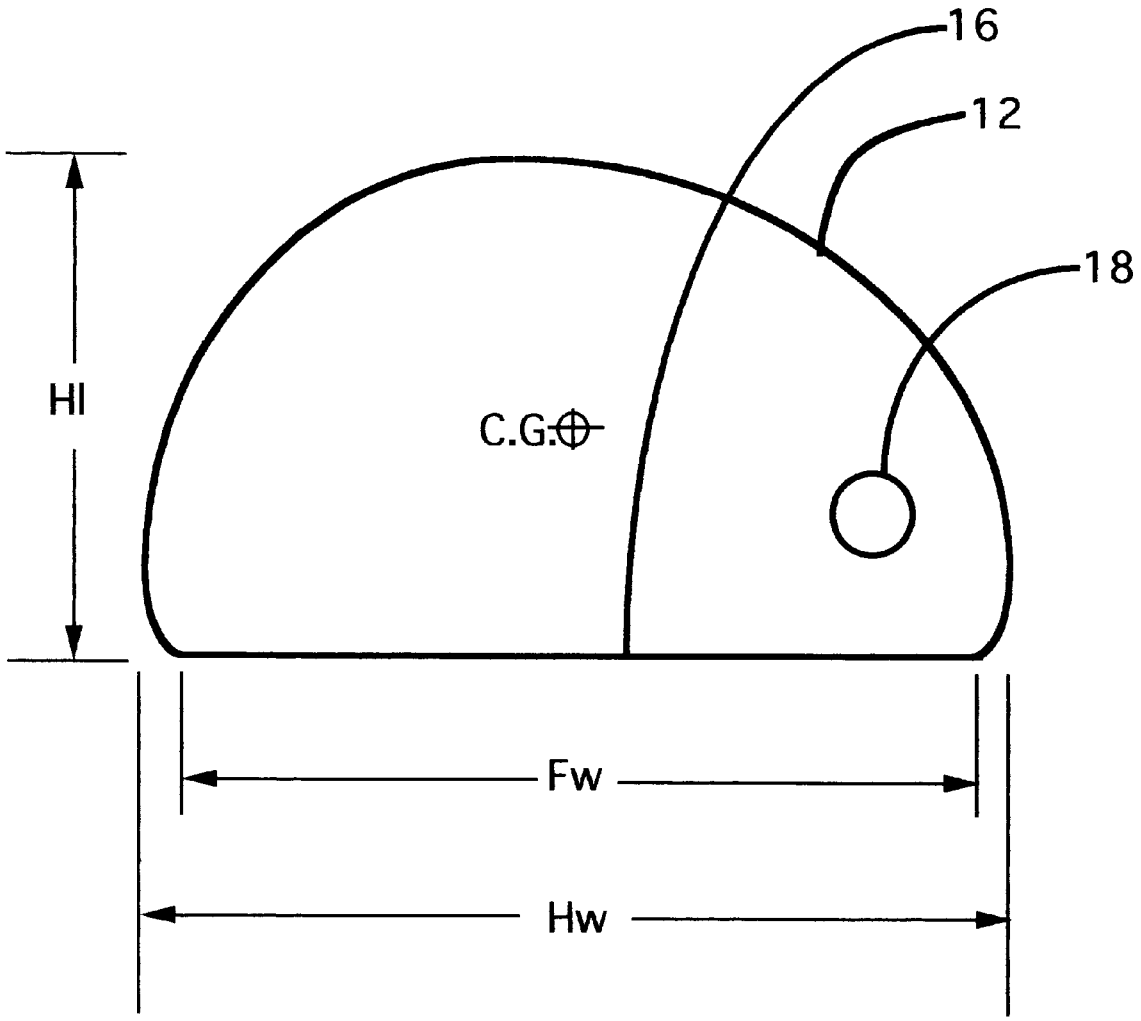
PRIOR ART FIGURE 1B
FIG. 1B is a top view of a conventional mallet type putter head.

FIG. 1B is a top view of a conventional mallet type putter head 12. As with the blade type putter head, the face width Fw is only slightly less the width of the putter head Hw making this putter head subject to to the same pre-putt alignment problems described for the blade type putter head shown in FIG. 1A. Also, as with blade type putters, if not gripped firmly, a putter utilizing a mallet type putter head can also twist in a golfer's hands if the putter head impacts the golf ball at or near the end of the putter head resulting in a misdirected putt. Another problem associated with some mallet type putter heads is their lack of symmetry. A non symmetrical putter head is more difficult to control during the backswing of the putt resulting in a lower percentage of positive contact with the golf ball.

Figure 2:
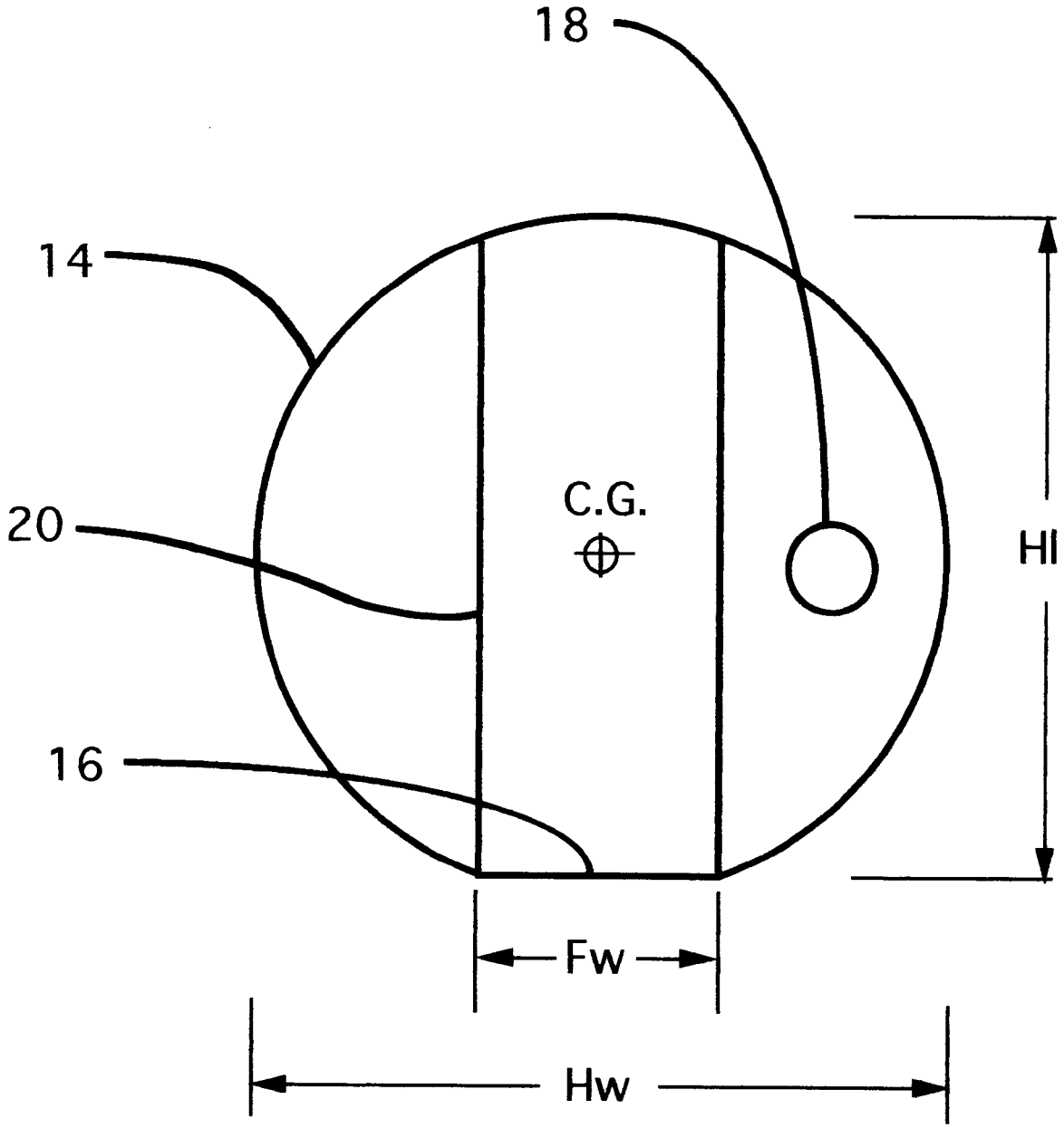
FIG. 2 is a top view of a putter head of the present invention.

FIG. 2 is a top view of a preferred embodiment of a putter head of the present invention 14. This figure shows the shape of the top of this putter head to be generally circular with the exception of a straight portion defining the top of face 16 of the putter head. In this particular embodiment, the head width Hw is 3 inches, the head length H1 is 2.9 inches, and the face width Fw is 1 inch. The top of this putter head is symmetrical with center of gravity C.G. located at a sufficient distance of 0.5 H1 (i.e. 1.45 inches) behind the putter head face 16 to insure control during the putter head backswing with a resulting high percentage of positive contact with the golf ball. The putter head face 16 is positioned at the front and center of the putter head. Reducing the putter head face width to one inch (i.e. one third putter head head width Hw) and having the C.G. located at a distance of 1.45 inches behind the the putter head face insures that error in the form of weak and ineffectual putts will be minimized because of a controlled backswing and the golf ball always impacting the putter head face at or very near the sweet spot. Also, the head length H1 being sufficiently long and the face width Fw being sufficiently short allows the putter head of the present invention to employ an alignment stripe 20 with dimensions H1 by Fw. Utilization of this alignment stripe simplifies the pre-putt alignment process by eliminating the need for positioning the putter face perpendicular to the line of sight to the cup. Alignment consists only of placing the putter head face behind the golf ball with the alignment stripe positioned on the line of sight to the cup. Finally, reducing the face width Fw to one inch and positioning the face at the front and center of the putter head eliminates the possibility of having the putter head twist in a golfer's hands upon impacting the golf ball in that this unique configuration eliminates the cause of twist (i.e. impacting a golf ball at or near the end of the putter head).

Figure 3:
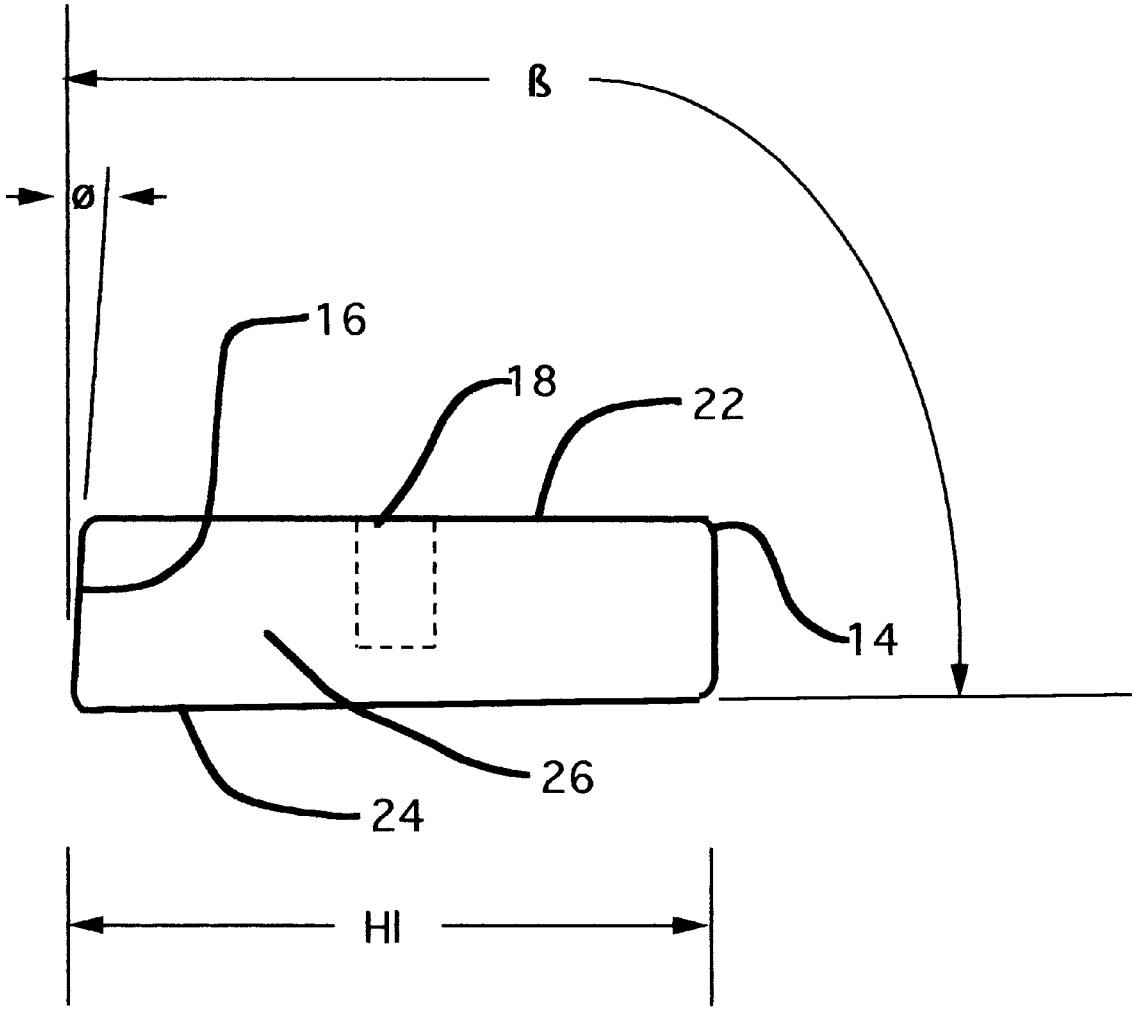
FIG. 3 is a side view of a putter head of the present invention.

FIG. 3 is a side view of a preferred embodiment of a putter head of the present invention 14. This figure shows the shape of the putter head of the present invention to be a modified disk having a flattened face 16 and a rounded rear 26. In this embodiment the edges of the top 22 and bottom 24 of the putter head are rounded using a radius of 0.1 inches. Also shown in this figure are the loft angle ø of putter head face 16 and the lie angle β of the putter head. For the putter head of the present invention, ø will normally have a range of 0 to 6 degrees, and β will have a range of 79 to 90 degrees. In the preferred embodiment shown in this figure, ø is 5 degrees and β is 85 degrees. The relative position of bore hole 18 as viewed from the side is also presented in this figure. The position, diameter, depth, and angle at which this bore hole is drilled can vary. In the preferred embodiment shown, the bore hole has a diameter of 0.37 inches, a depth of 0.57 inches, and is drilled at an angle of 90 degrees relative to top 22 of the putter head.

Figure 4:
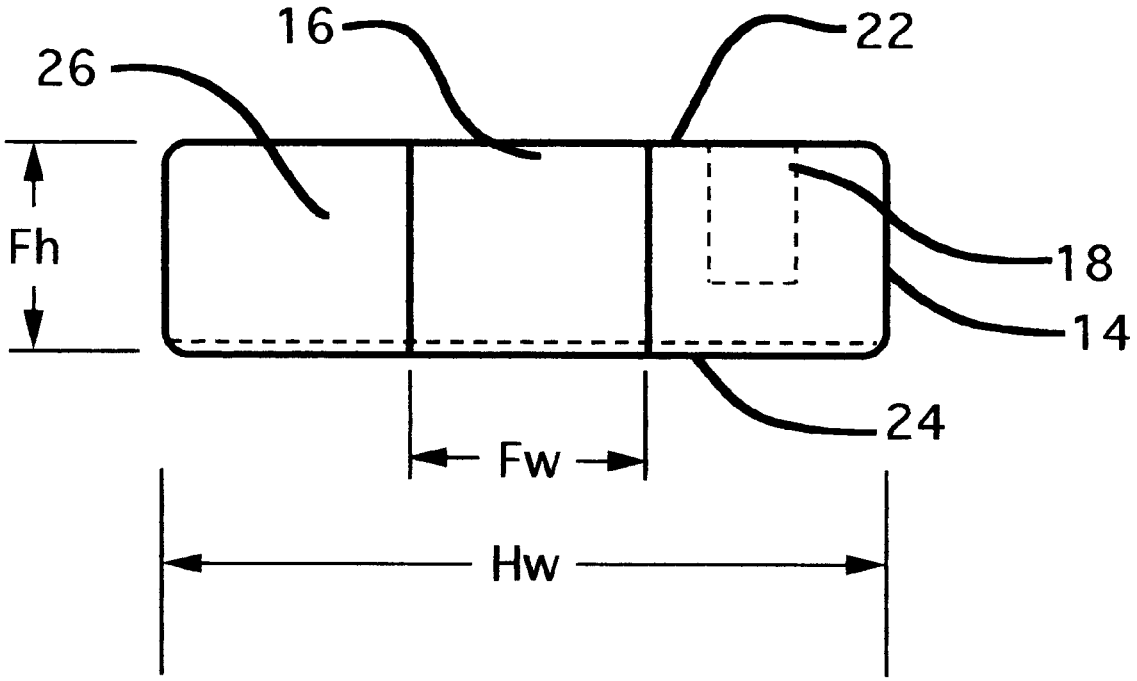
FIG. 4 is a front view of a putter head of the present invention.

FIG. 4 is a front view of a preferred embodiment of a putter head of the present invention 14. This figure shows the the height Fh and the width Fw of putter head face 16 to be 0.85 inches and 1 inch respectively. This figure also shows that putter head face 16 is positioned at the front and center of putter head 14. The relative position of bore hole 18 is presented. Also presented is rounded rear 26 and a dashed (hidden) horizontal line to show the front to back slope of putter head bottom 24.

Figure 5:
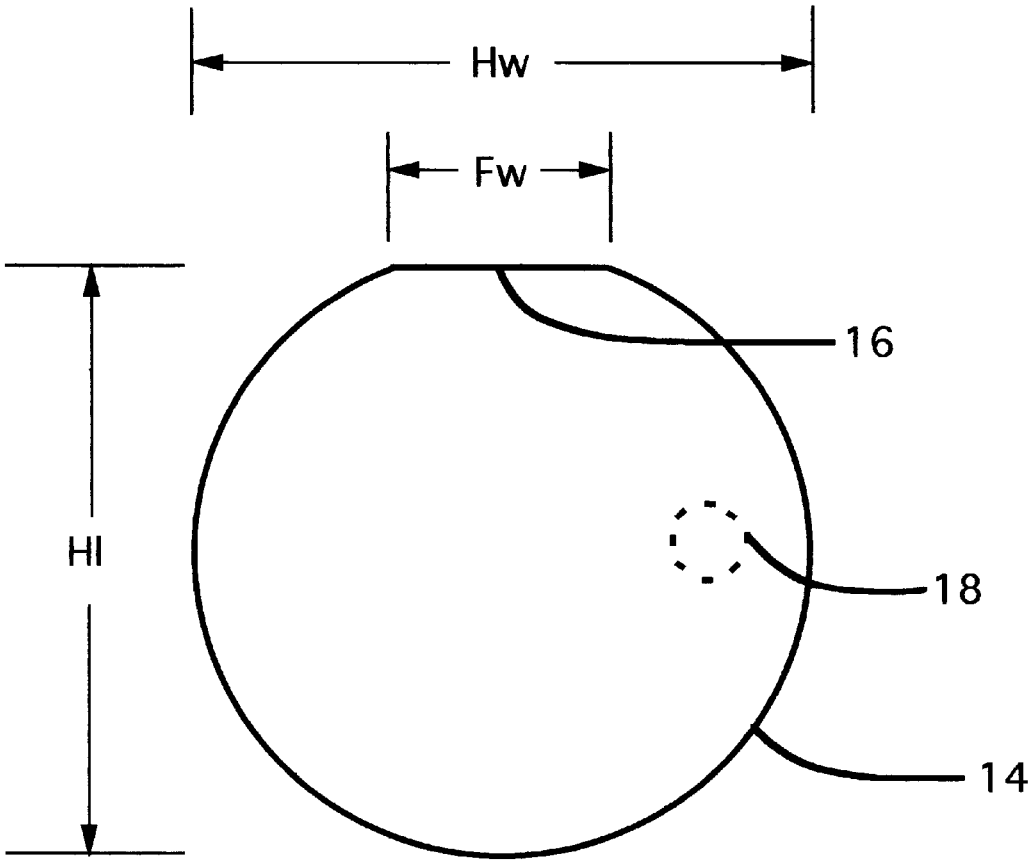
FIG. 5 is a bottom view of a putter head of the present invention.

FIG. 5 is a bottom view of a preferred embodiment of a putter head of the present invention 14. This figure shows the shape of the bottom of this putter head to be generally circular with the exception of a straight portion defining the bottom of face 16 of the putter head. As shown in this figure, the putter head of the present invention is solid. It has no weight reducing body cavities. This is because this preferred embodiment has been milled from a block of solid aluminum. If the putter head of the present invention were to be made from a heavier metal such as steel, weight reducing body cavities would probably be required.

Figure 6:
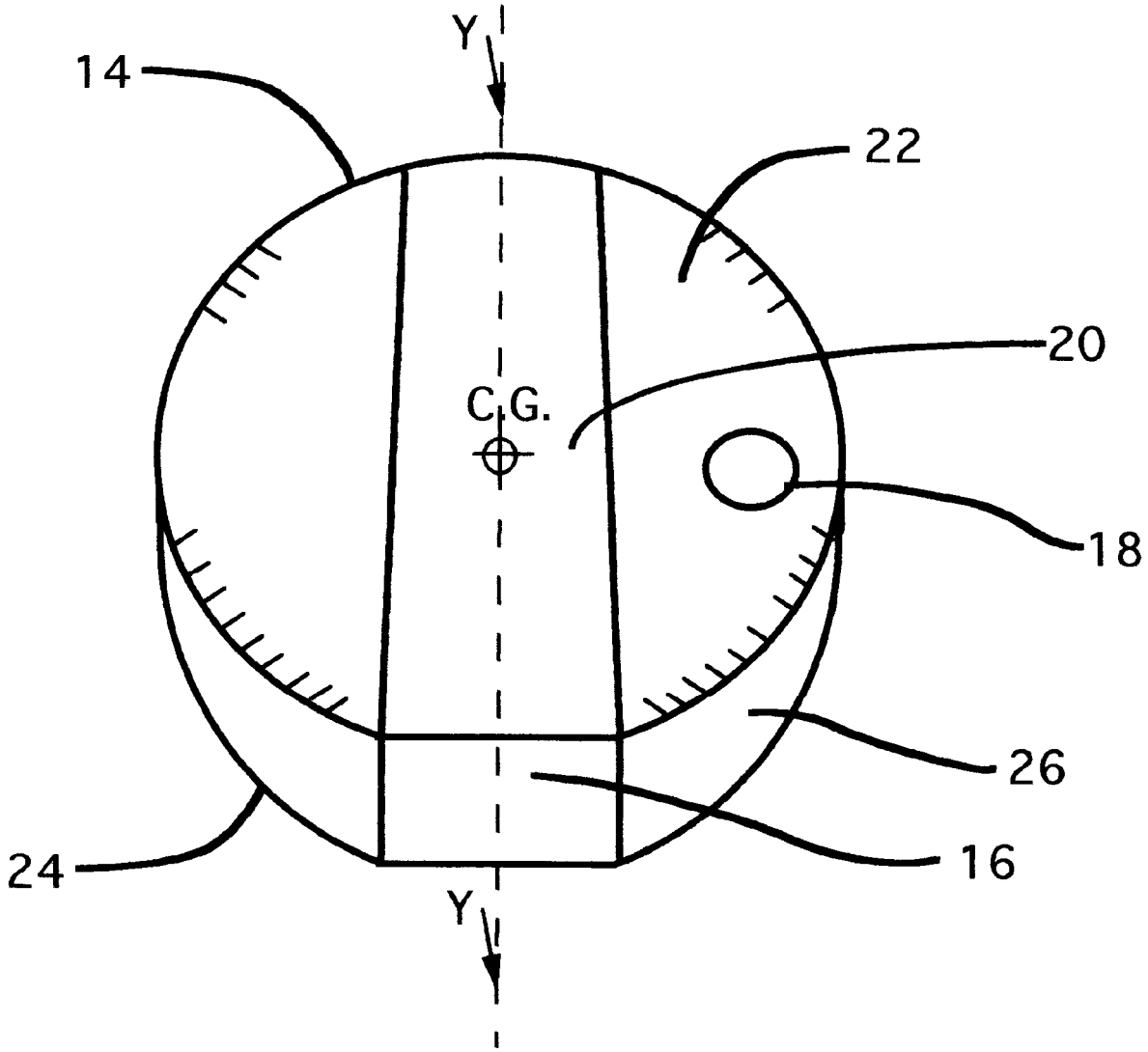
FIG. 6 is an isometric view of a putter head of the present invention.

FIG. 6 is an isometric view of a preferred embodiment of a putter head of the present invention 14. This figure shows the unique disk like shape of the putter head of the present invention. This figure also shows the putter head to be symmetrical in that one vertical middle plane YY bisects face 16, rounded rear surface 26, top surface 22, bottom surface 24, and alignment stripe 20. The location of the putter head center of gravity on vertical middle plane YY is also shown. Also presented are the relative size and position of face 16 and position of bore hole 18 which receives the putter shaft .

Summary, Ramifications, and Scope

Accordingly, the reader will see that the putter head of the present invention is a unique innovation. It is the first putter head having generally disk like shape with top and bottom surfaces generally circular in shape, a rounded rear surface, and positioned front and center, a flattened face for striking a golf ball. The width of this face being approximately one third the width of the putter head. The putter head also utilizes an alignment stripe and has a center of gravity positioned at a sufficient distance behind the face of the putter head to provide backswing control. The unique shape of the putter head, size and position of the putter head face, alignment stripe, and location of the center of gravity allows the putter head of the present invention to offer the following advantages over prior art:

(a) It allows the pre-putt alignment procedure to be simplified and improved thereby providing more accurate putts (b) It will consistently impact the golf ball on "sweet spot" of the putter head face thereby eliminating weak and ineffective putts (c) It provides a shorter more controlled putter head backswing with a resulting high percentage of positive contact with the golf ball.

(d) It eliminates putter head twist when impacting the golf ball thereby reducing misdirected putts.

Although the description above contains specifics relative to the size and utilization of the putter head of the present invention, these should not be construed as limiting the scope of the invention but merely providing illustrations of a preferred embodiment and utilization of this invention. It will be understood that modifications (for example making the shape of the putter head generally oval or ellipsoidal) could be made and other embodiments of the principles of this invention will occur to those skilled in the art to which this invention pertains, particularly upon considering the foregoing teachings. It is contemplated that any such modifications or embodiments that incorporate the essential features of this invention will be covered within the true spirit and scope of the following claims. Thus the scope of the putter head of the present invention should be determined by the appended claims and their legal equivalents.

I claim:

1. A putter head generally shaped like a disk, said putter head consisting of top and bottom surfaces generally circular in shape, a rear surface being rounded, and a front surface being flattened thereby providing a face for striking a golf ball, and wherein the width of said face is approximately equal to one third the width of the putter head.

2. The golf putter head of claim 1 wherein said putter head has a stripe on the top surface for the purpose of simplifying and improving the pre putt alignment process, said stripe having a width equal to the width of the putter head face and a length equal to the length of the putter head.

3. The golf putter head of claim 2 wherein said putter head includes a vertical middle plane which bisects the putter head face, rounded rear surface, top and bottom surfaces, and alignment stripe.

4. The golf putter head of claim 3 wherein the center of gravity of said putter head is located behind the putter head face on the vertical middle plane at a distance of approximately one half the putter head length.

* * * * *

UNITED STATES PATENT AND TRADEMARK OFFICE

CERTIFICATE OF CORRECTION

PATENT NO. : 5,993,330

DATED : November 30, 1999

INVENTOR(S) : Thomas Chester Akerstrom

It is certified that error appears in the above-identified patent and that said Letters Patent is hereby corrected as shown below:

Title page, item [76], inventor: Thomas Chester Akerstrom, 18336 Soledad Canyon Rd., Canyon Country, Calif. 91351 to:

[76] Inventor: Thomas Chester Akerstrom, 28988 Flowerpark Drive, Canyon Country, Calif. 91351

Signed and Sealed this

Twenty-second Day of August, 2000

*Attest:*

Q. TODD DICKINSON

*Attesting Officer*

*Director of Patents and Trademarks*